US006854133B2

(12) United States Patent
Lee et al.

(10) Patent No.: US 6,854,133 B2
(45) Date of Patent: Feb. 15, 2005

(54) PROTECTIVE HEADGEAR FOR WHITEWATER USE

(75) Inventors: Chang Lee, Lawrenceville, GA (US); Michael C. Cordeiro, Baltimore, MD (US); Andrew F. Conn, Baltimore, MD (US)

(73) Assignee: Whitewater Research and Safety Institute, Park City, UT (US)

( * ) Notice: Subject to any disclaimer, the term of this patent is extended or adjusted under 35 U.S.C. 154(b) by 0 days.

(21) Appl. No.: 10/438,754

(22) Filed: May 14, 2003

(65) Prior Publication Data

US 2003/0221245 A1 Dec. 4, 2003

Related U.S. Application Data

(60) Provisional application No. 60/380,765, filed on May 14, 2002, and provisional application No. 60/405,946, filed on Aug. 26, 2002.

(51) Int. Cl.[7] ..... A42B 7/00
(52) U.S. Cl. ..... 2/421; 2/412
(58) Field of Search ..... 2/411, 412, 421, 2/425

(56) References Cited

U.S. PATENT DOCUMENTS

| | | | | |
|---|---|---|---|---|
| 2,846,683 | A | | 8/1958 | Dye et al. |
| 3,447,163 | A | | 6/1969 | Bothwell et al. |
| 3,943,572 | A | | 3/1976 | Aileo |
| 3,946,441 | A | | 3/1976 | Johnson |
| 3,958,276 | A | | 5/1976 | Clausen |
| 3,992,721 | A | | 11/1976 | Morton |
| 4,016,734 | A | | 4/1977 | Morton |
| 4,020,507 | A | | 5/1977 | Morton |
| 4,038,700 | A | | 8/1977 | Gyory |
| 4,044,399 | A | | 8/1977 | Morton |
| 4,044,400 | A | * | 8/1977 | Lewicki et al. ..... 2/421 |
| 4,134,156 | A | | 1/1979 | Gyory |
| 4,282,610 | A | | 8/1981 | Steigerwald et al. |
| 4,292,882 | A | | 10/1981 | Clausen |
| 4,375,108 | A | | 3/1983 | Gooding |
| 4,422,183 | A | | 12/1983 | Landi et al. |
| 4,475,248 | A | | 10/1984 | L'Abbe et al. |
| 4,586,200 | A | | 5/1986 | Poon |
| RE32,569 | E | | 1/1988 | Aileo et al. |
| 4,808,469 | A | | 2/1989 | Hiles |
| 5,088,130 | A | | 2/1992 | Chiarella |
| 5,318,018 | A | | 6/1994 | Puma et al. |
| 5,336,708 | A | | 8/1994 | Chen |
| 5,524,641 | A | | 6/1996 | Battaglia |
| 5,570,946 | A | | 11/1996 | Chien |
| 5,615,769 | A | | 4/1997 | Stephenson |
| 5,669,079 | A | | 9/1997 | Morgan |
| 5,680,656 | A | | 10/1997 | Gath |
| 5,713,082 | A | | 2/1998 | Bassette et al. |
| 5,790,988 | A | | 8/1998 | Guadagnino, Jr. et al. |
| 5,794,270 | A | | 8/1998 | Howat |
| 5,898,950 | A | | 5/1999 | Spyrou et al. |
| 5,915,537 | A | | 6/1999 | Dallas et al. |
| 5,915,819 | A | | 6/1999 | Gooding |
| 5,943,706 | A | | 8/1999 | Miyajima et al. |
| 5,947,918 | A | | 9/1999 | Jones et al. |
| 5,950,244 | A | | 9/1999 | Fournier et al. |
| 5,956,777 | A | | 9/1999 | Popovich |

(List continued on next page.)

*Primary Examiner*—Rodney M. Lindsey
(74) *Attorney, Agent, or Firm*—Thorpe North & Western

(57) ABSTRACT

Protective headgear configured for protection of a portion of a wearer's head, including a resilient outer shell, a layered composite liner including a multiplicity of deformable layers, each layer having a different stiffness than adjacent layers, and wherein a layer has a higher stiffness than that of adjacent layers on either side, and a retention system configured to resist upward/rearward rotation of the headgear with respect to the wearer's head to expose the forehead, due to hydrodynamic or aerodynamic forces.

7 Claims, 5 Drawing Sheets

U.S. PATENT DOCUMENTS

| | | | |
|---|---|---|---|
| 5,988,098 | A | 11/1999 | Hillhouse |
| 6,048,379 | A | 4/2000 | Bray et al. |
| 6,070,271 | A | 6/2000 | Williams |
| 6,105,172 | A | 8/2000 | Shida |
| 6,105,176 | A | 8/2000 | Egger |
| 6,154,889 | A | 12/2000 | Moore, III et al. |
| 6,159,324 | A | 12/2000 | Watters et al. |
| 6,219,850 | B1 | 4/2001 | Halstead et al. |
| 6,226,803 | B1 | 5/2001 | Tanaka |
| 6,266,827 | B1 | 7/2001 | Lampe et al. |
| 6,272,692 | B1 | 8/2001 | Abraham |
| 6,282,724 | B1 | 9/2001 | Abraham et al. |
| 6,292,213 | B1 | 9/2001 | Jones |
| 6,292,952 | B1 | 9/2001 | Watters et al. |
| 6,292,954 | B1 | 9/2001 | O'Bradaigh et al. |
| 6,298,483 | B1 | 10/2001 | Schiebl et al. |
| 6,301,718 | B1 | 10/2001 | Rigal |
| 6,311,338 | B1 | 11/2001 | Galet |
| 6,332,226 | B1 | 12/2001 | Rush, III |
| 6,332,228 | B1 | 12/2001 | Takahara |
| 6,351,853 | B1 | 3/2002 | Halstead et al. |
| 6,357,054 | B1 | 3/2002 | Bainbridge et al. |
| 6,360,376 | B1 | 3/2002 | Carrington |
| 6,374,423 | B1 | 4/2002 | Anderson et al. |
| 6,378,140 | B1 | 4/2002 | Abraham et al. |
| 6,381,760 | B1 | 5/2002 | Lampe et al. |
| 6,385,780 | B1 | 5/2002 | Racine |
| 6,405,382 | B2 | 6/2002 | Shida |
| 6,421,841 | B2 | 7/2002 | Ikeda |
| 6,425,141 | B1 | 7/2002 | Ewing et al. |
| 6,446,270 | B1 | 9/2002 | Durr |
| 6,453,476 | B1 | 9/2002 | Moore, III |
| 6,453,477 | B1 | 9/2002 | Bainbridge et al. |
| 6,490,730 | B1 | 12/2002 | Lyden |
| 6,530,564 | B1 | 3/2003 | Julien |
| 6,560,787 | B2 | 5/2003 | Mendoza |
| 6,604,246 | B1 | 8/2003 | Obreja |
| 6,635,327 | B2 | 10/2003 | Ohira et al. |
| 6,645,586 | B2 | 11/2003 | Ohira et al. |
| 6,658,671 | B1 | 12/2003 | Von Holst et al. |
| 6,671,889 | B2 | 1/2004 | Dennis et al. |
| 2002/0023291 | A1 | 2/2002 | Mendoza |
| 2002/0060633 | A1 | 5/2002 | Crisco, III et al. |
| 2002/0120978 | A1 | 9/2002 | Moore, III |
| 2002/0174480 | A1 | 11/2002 | Lombard |

* cited by examiner

PROTECTIVE HEADGEAR FOR WHITEWATER USE

This application claims priority of U.S. Provisional Application Ser. No. 60/380,765 filed May 14, 2002 now abandoned, and of U.S. Provisional Application Ser. No. 60/405,946 filed Aug. 26, 2002 and the disclosures of each are hereby incorporated herein by reference.

BACKGROUND OF THE INVENTION

1. Field of the Invention

The present invention relates generally to safety equipment for protecting the head of a human. More particularly, the present invention relates to protective headgear for reducing the probability of head injury and mitigating the effects of impacts to the area of the cranium.

2. Related Art

Protective headgear, in various forms, has been known for millennia. More recently, headgear suited for cranial protection in outdoor recreational activities, including biking, climbing, skydiving, skateboarding, rollerblading, skiing, snowboarding, and the like, have been developed. These typically include a shell configured to be impact resistant, and a liner, typically formed of a energy absorbing, and/or shock mitigating material, such as a foamed polymeric resin, and a retention system. The retention system typically comprises one or more straps which attach to the shell and extend down around at least a chin portion of the head of a wearer. A clasp, buckle or snap of some kind, or other means for releasably fastening the strap(s) so as to retain the headgear on the head of the wearer is usually provided.

The shell is typically formed of an impact resistant and relatively hard material. This is to mitigate impacts by resisting penetration and spreading resistance to the impact force laterally from an impact point. Among the advantages this provides is enabling more of the liner to be brought into play in mitigating the impact, rather than relying on the portion of the liner directly below a point of impact.

The liner typically is a closed cell foam or a combination of open and closed cell foams. Some liner systems are designed to convert impact energy to heat through deformation beyond the elastic limit of the material(s). Expanded polystyrene and other relatively rigid but progressively collapsible foamed resins are examples of such systems. Other systems are designed to shed energy by conversion to heat by deformation within the elastic range of the material (s). A combination of deformation within and without the elastic range is known. For example, some systems have a deformable layer adjacent the shell, and an elastomeric layer between the head of the wearer and the deformable layer. This inner layer is often pads of an open cell foam (or a closed cell foam) adhesively attached to the deformable layer. The elastomeric layer also allows at least a small amount of adaptability to differing head sizes. Overcompression of the elastomeric foam can reduce its effectiveness somewhat, and a too-loose fitting helmet can shift and expose a portion of the head sought to be protected, so such liners, and shells, are sized for different sizes of heads, and only a limited amount of variation is accommodated.

Typically the liner also serves, along with the shell, to spread impact forces laterally, to reduce the force per unit area on the head of the wearer. So at least some rigidity, or more properly shear force transfer, is desirable. But this must be balanced with the energy absorption properties to achieve good results. One approach taken to providing for this dual role of the liner is to provide a composite liner of differing material layers. An example of such a system has just been mentioned. At least one layer that has a higher shore hardness for spreading of the impact force, and at least one layer of lower shore hardness for absorption, or "cushioning" have been used. Liners having a multiplicity of layers are known. U.S. Pat. No. 6,425,141 sets forth an example of such a system.

The protective headgear can vary somewhat depending on the use to which it will be put. For example, protective helmets purpose designed for bicycle racing tend to be more aerodynamically shaped and ventilated than those designed with rock climbing or spelunking in mind. However, many helmet designs have typically been used in more than one activity. That is to say, there is a perception among some, that a helmet is a helmet, and the important thing is that a participant in an activity wear a helmet, not the particulars of the helmets design.

While it is usually true than any helmet is better than no helmet, nevertheless, some factors that may affect helmet performance in one activity may not obtain in another, and so if a helmet is designed with the former in mind, the helmet may not be totally adequate in the latter. For example, in whitewater sporting activities hydrodynamic forces can be very strong. The flow of water can shift a helmet on the head of the wearer, for example rotating it up and back, exposing the forehead area of the cranial portion of the wearers head intended to be protected. Such forces are not so important in skateboarding, hockey, rock climbing, etc. and are not typically a major concern in the design of helmets for such activities.

However, a wearer of a helmet designed with skateboarding or rock climbing in mind may be at increased risk of injury or death due to shifting of the helmet if the helmet is worn for head protection during kayaking or skydiving activities. For example, hydrodynamic or aerodynamic forces can shift such a helmet as discussed above.

In the whitewater-sporting activity example, a non-fatal head injury can result in death due to secondary causes such as drowning or blunt-force trauma to other parts of the body which arise because the non-fatal head injury caused temporary unconsciousness and loss of breathing control and the ability to avoid hazards. Therefore, in this activity, protection of the head is if anything only more important because any head injury resulting in unconsciousness is potentially fatal due to secondary causes such as those mentioned.

SUMMARY OF THE INVENTION

It has been recognized that it would be advantageous to develop protective headgear suitable for the whitewater environment. It is recognized that such headgear may have other applications. The inventors have accordingly provided for mitigation of heavy impacts and for mitigation of forces tending to shift the headgear to expose the forehead of the wearer.

The invention provides a protective headgear configured for protection of a portion of a wearer's head, including a resilient outer shell, a layered composite liner including a multiplicity of deformable layers, each layer having a different stiffness than adjacent layers, and wherein a layer has a higher stiffness than that of adjacent layers on either side, and a retention system configured to resist upward/rearward rotation of the headgear with respect to the wearer's head to expose the forehead, due to hydrodynamic or aerodynamic forces.

Additional features and advantages of the invention will be apparent from the detailed description which follows, taken in conjunction with the accompanying drawings, which together illustrate, by way of example, features of the invention.

DETAILED DESCRIPTION

Figure 1:
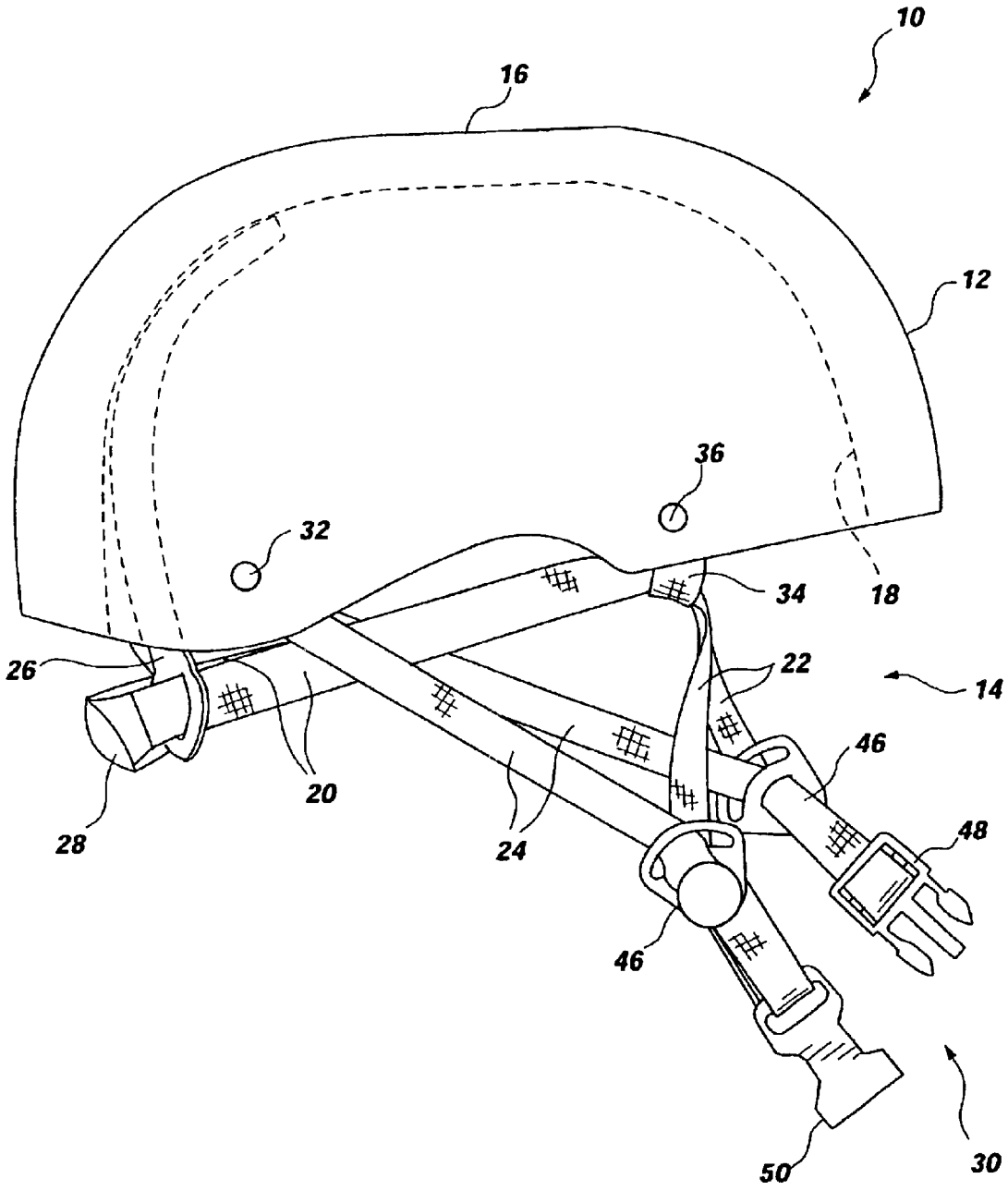
FIG. 1 is a right side perspective view of protective headgear in accordance with an embodiment of the present invention (left side is a mirror image)

Reference will now be made to the exemplary embodiments, as are illustrated in the drawing figures and the following discussion. Specific language will be used herein to describe the same. It will nevertheless be understood that no limitation of the scope of the invention is thereby intended.

Figure 2:
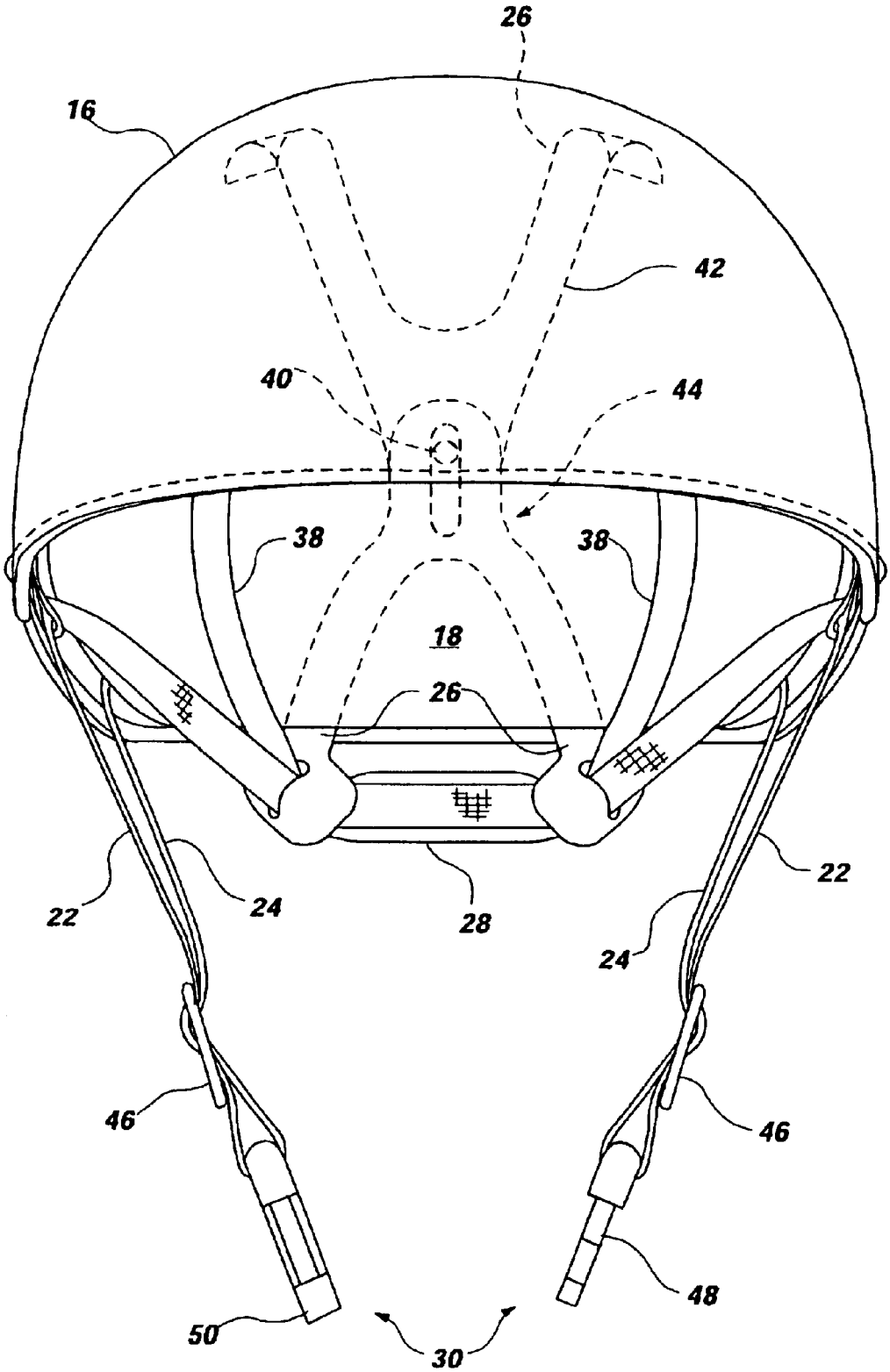
FIG. 2 is a front perspective view of the headgear of FIG. 1.
Figure 3:
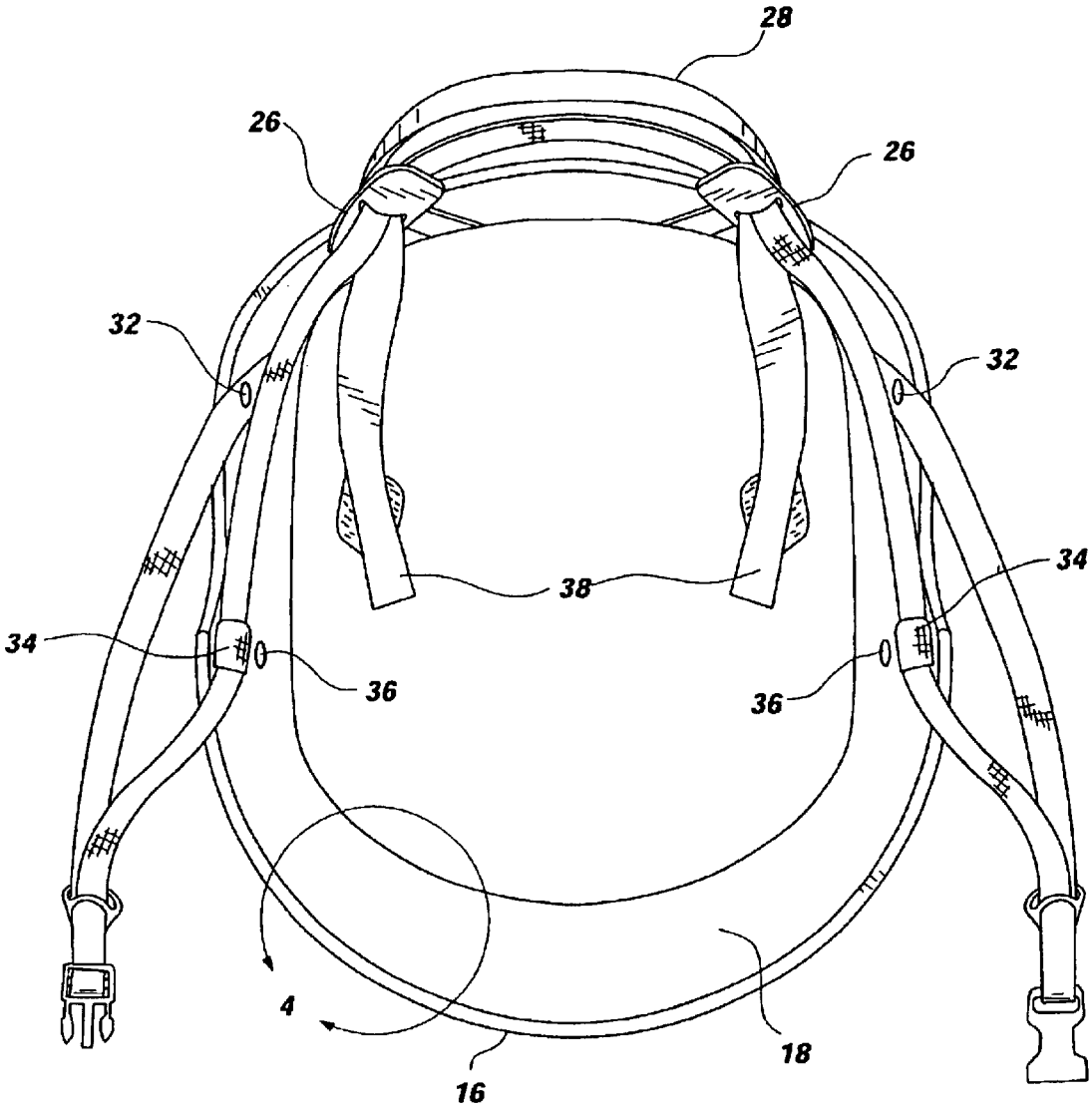
FIG. 3 is a bottom perspective view of the headgear of FIG. 1.

As illustrated in FIGS. 1, 2, and 3 protective headgear 10 comprising a helmet 12 and retention system 14, in accordance with the invention is configured for whitewater activities. The helmet includes a shell 16 and a liner 18. The retention system includes, on each side, a nape strap portion 20 and a forward chin strap portion 22, as well as a rearward chin strap portion 24. A nape strap locator yoke 26 holds the nape strap in a location to engage a nape of a wearer's head (not shown). A nape rest pad 28 can be provided for increased comfort and to assist in retention, and cooperates with other structure in adjustment of the retention system as will be discussed below.

The strap portions 20, 22, 24 are attached to the helmet 12 at a number of places, the locations being selected to assist in stabilizing the helmet on the head of a wearer. The rearward chin strap portion 24 comprising the rearward legs of a chin strap 30 on each of the left and right side of the helmet 12, is fixedly attached to the shell 16 by a fastener 32 on each side. The connection of the rearward chin strap portion and the shell is located behind the ear of a wearer (not shown). The forward chin strap portion 22 on each side, comprising a forward leg of the chin strap, is connected in a slidable fashion to the shell by a loop of strapping 34 fixedly connected to the shell by a fastener 36. Now in each case the fasteners 32, 36 can prevent or can allow rotation of the strap 24 or loop 34 about an axis through a point of connection, but in the case of the rearward strap portion the strap is prevented from relative translational movement with respect to the shell, whereas at the forward connection comprising the loop 34 and fastener 36, translational movement of the strap is allowed in the illustrated embodiment. By a fixed connection what is meant is that relative translational movement of the strap and the helmet is not allowed. The purpose of the slidable forward connection provided by the loop is that a force tending to move the helmet 12 upward with respect to the head of a wearer sets up an elliptical motion of the helmet about the chin and nape of the neck; foci if you will, connected by the strap comprising the forward leg 22 of the chin strap and rearward nape portion 20. This motion has a rearward component as well as an upward component. The rearward reaction component pushes the helmet inward closer to the head of a wearer, setting up increased frictional resistance to upward/rearward motion. This has the result of tending to keep the helmet 12 from rotating upward and back with respect to the head in response to an upwardly directed external force as much as would otherwise be the case. This gives rise to increased resistance to such movement as a result of hydrodynamic or aerodynamic forces which would otherwise push the helmet up, out, and back, to expose the forehead to potential injury.

The retention system also includes an adjustment strap 38 which releasably and adjustably attaches to the liner 18 via hook and loop fasteners and runs through the nape strap locator yoke 26 with the nape strap. The position of the nape strap at its rearwardmost portion can be adjusted with respect to the helmet by moving ends of the adjustment strap 38 to shorten or lengthen it. Further the nape strap locator yoke 26 can further comprise an adjustment feature 40 which allows it to move with respect to the helmet also. An upper portion 42 of the yoke is affixed to the shell 16, while a lower part 44 can be adjusted in position with respect to the helmet. This allows the head protection 10 to be worn by different persons.

In addition to adjustability of the position of the nape strap, the chin strap can be adjusted, for example in a conventional manner by providing sliding buckles 46 allowing adjustment of the lengths of the nape strap portion 20 forward chin strap portion 22, rearward chin strap portion 24, etc. Further, a releasable clip connector buckle having male 48 and female 50 portions is provided for releasable attachment of the head protection system 10 to the head of a wearer.

Figure 4:
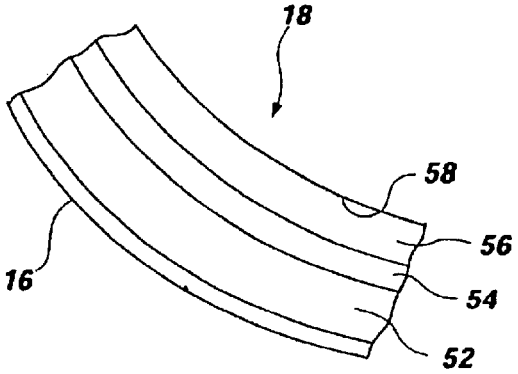
FIG. 4 is an enlarged view of the area 4—4 identified in FIG. 3.

The liner 18 can be formed of one of a number of conventionally used materials, and further can comprise one, two, or a multiplicity of layers. With reference to FIGS. 3 and 4, in one embodiment the liner can comprise a multiplicity of layers, and two adjoining layers can each have a different shore hardness. In one embodiment closed cell foam can be employed for one or more layers of the liner. Using closed cell foam can make the helmet more buoyant.

In one embodiment impact energy dissipation is enhanced by using a three layer system for the liner 18. An outer layer 52 is relatively less hard than a middle layer 54, and less hard than the outer shell 16. The middle layer is more rigid than the outer layer, and an inner layer 56. The increased effectiveness can be explained in a number of ways. On one level, the increase in performance can be thought of as using one or more layers of relatively softer foam for energy dissipation, and one or more layers to assist the outer shell in distributing the impact force over a wider area, lowering the resulting accelerations at the wearer's head overall. On another, more analytical, level, the increase in performance can be attributed to better exploitation: of a) stress wave interactions; and b) hysteresis, in kinetic to heat energy conversion, dissipating impact forces to reduce the accelerations overall at an inner surface 58 of the inner layer 56 adjacent a wearer's cranium.

Figure 5:
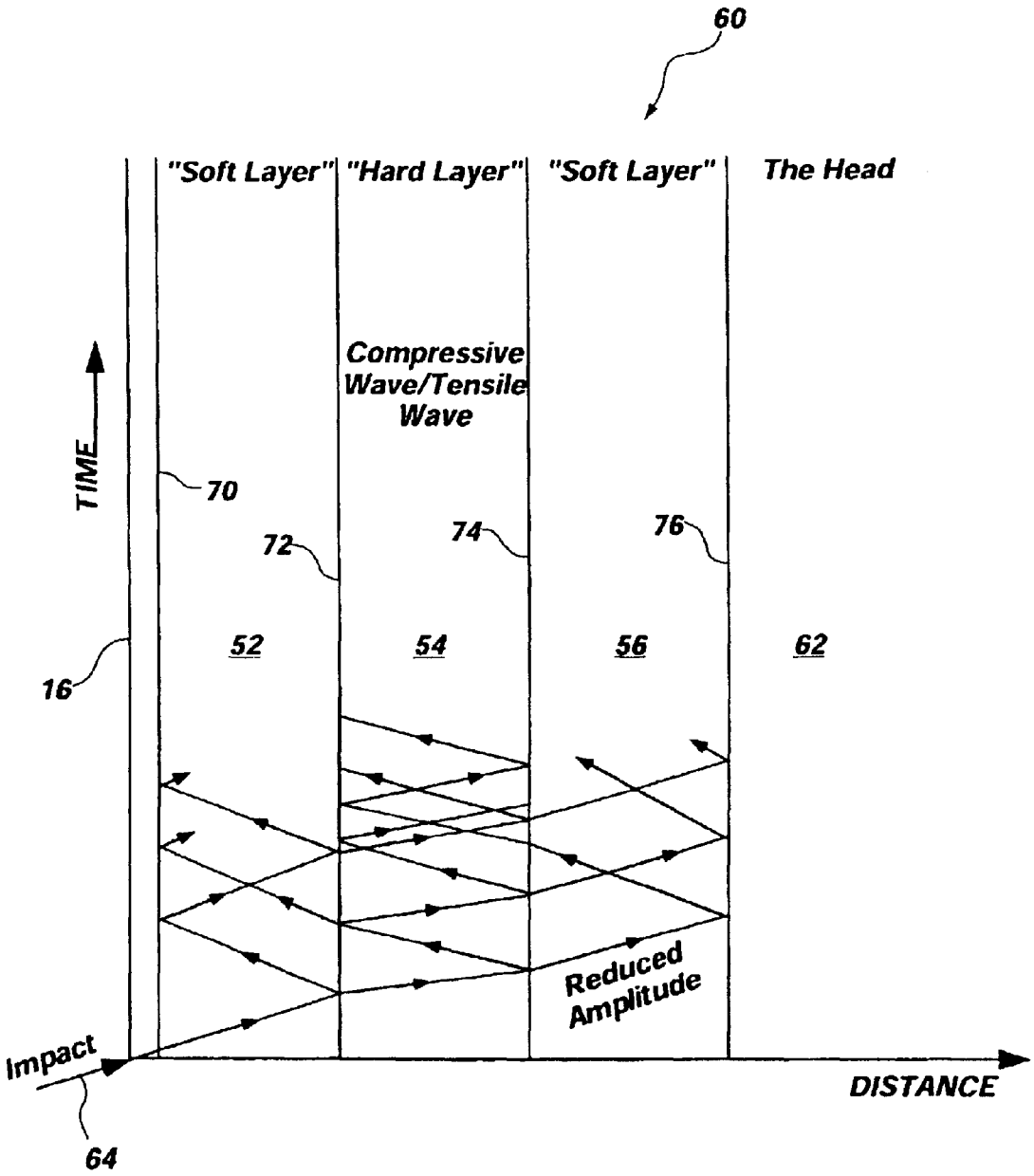
FIG. 5 is a schematic diagram overlaid with a time distance plot illustrating impact wave propagation through the area identified in FIG. 4 as a result of an impact to the shell of the helmet of the headgear.

With reference to FIG. 5, the response of a structure 60 which comprises multiple layers 16, 52, 54, 56 over a head 62 of a wearer to an impact loading is indicated schematically. This pseudo-time vs. distance plotting of the leading edges of stress waves superimposed on the structure is a convenient way to illustrate what happens when an impact-induced stress wave enters such a multi-layered system.

By way of definitional background, the concept of a wave is familiar in settings such as water waves and sound waves in air. A wave is a mechanical process wherein energy is transferred through a material. Although there is a relatively small local movement of material within the body of material through which the wave is passing as the wave passes by, the wave itself can travel all the way through the material, and can be reflected. For example ocean water molecules move a small amount in a generally circular path, as the wave passes through, but the wave itself can travel for miles and miles. The stress wave set into motion in the helmet structure 60 by an impact 64 occasioned by the collision of the shell 16 with a hard surface (not shown) such as found on an object formed of rock, concrete, steel, or the like. The wave begins to propagate (move) into materials from which the helmet structure 60 is constructed. The stress wave interactions occur when this wave tries to move from one material to another, as discussed below.

The layers in FIG. 5, moving from left to right, are: a) the hard shell 16 of the helmet structure 60; b) the relatively "soft" outermost layer 52 of energy absorbing foam; c) the relatively "hard" middle layer 54 of energy absorbing foam; d) the relatively "soft" innermost layer 56 of energy absorbing foam; and e) the wearer's head 62 which the helmet is protecting. The terms "soft" and "hard" are actually just a shorthand way of expressing the relative dynamic properties of these foam materials.

Figure 6:
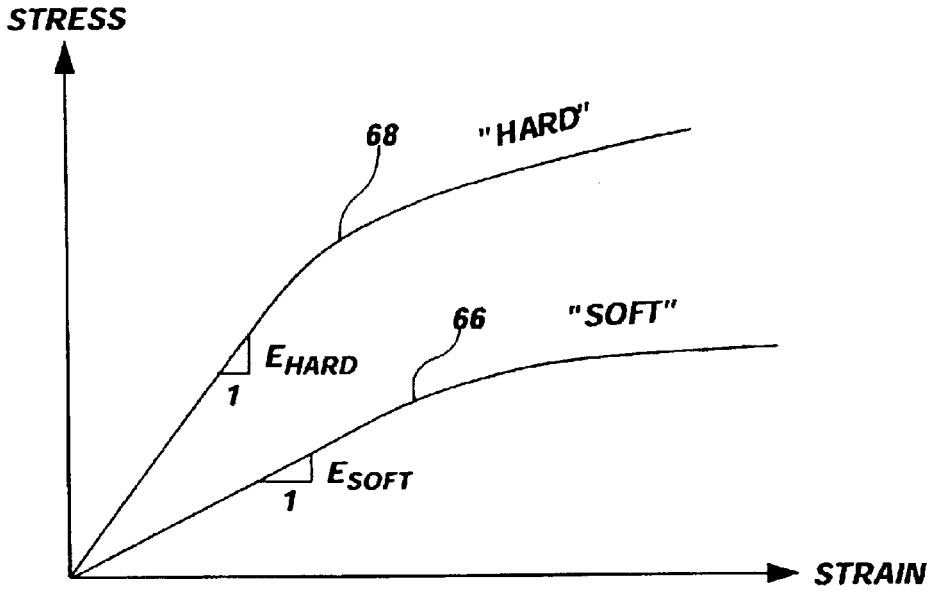
FIG. 6 is a schematic stress-strain diagram illustrating differences in relatively hard and soft layer materials of a composite layered liner system as shown in FIGS. 3, 4 and 5.

With reference to FIG. 6, the stress vs. strain curves 66, 68, respectively, indicate the relative dynamic properties of the materials characterized as relatively more "soft" and relatively more "hard." The modulus of elasticity, E, is the slope of the stress strain curve, and it is emphasized that the curves are based on dynamic testing, not static testing. Static testing such as is done using a conventional Universal Testing Machine involves a static deformation which occurs over time following application of the force at the surface of the material. Dynamic testing as used herein means a suitable test involving an impact to the material to determine the rapidity with witch it can deform in response to an impact.

A material property used to indicate its dynamic response is "Z" the dynamic impedance. Z is calculated as follows, remembering that E is the slope of the stress strain curve in FIG. 6, and p is the density of the material. The speed of the stress wave in the material is the square root of $E/\rho$. The dynamic impedance Z is $\rho c$. Returning to FIG. 5, the relative sizes of Z at the interfaces 70, 72, 74, 76 between two materials (e.g. 52, 54) determines how a stress wave interacts at that boundary. For a propagating compressive wave such as is under consideration here, as a result of the impact 64, transitioning from a soft to hard material gives rise to compressive reflection, and from hard to soft gives rise to tensile reflection. In other words, when a compressive wave component reaches an interface 72 where the wave, traveling in a softer material (i.e. a lower value of Z) 52 encounters a harder material (i.e. a higher value of Z) 54 the wave component that is reflected will be compressive. When a compressive wave component reaches an interface 74 wherein the wave, traveling in a harder material (i.e. a higher value of Z) 54 encounters a softer material (i.e. a lower value of Z) 56 the wave component that is reflected will be tensile. Similarly, a tensile wave component moving from a softer to a harder material will cause a tensile reflection, whereas a tensile wave component moving from a harder to a softer material will give rise to a compressive reflected wave component.

These four possible types of interactions that can occur at the boundaries 70, 72, 74, 76 between materials 16, 52, 54, 56, 62 are what give rise to the various interactions depicted. It can be seen that in the middle, or hard, layer 54 these interactions cause this material to be repeatedly cycled between compressive and tensile loading. It is this cycling which gives rise to the second principle involved in the energy dissipation, namely the hysteresis effect mentioned.

Figure 7:
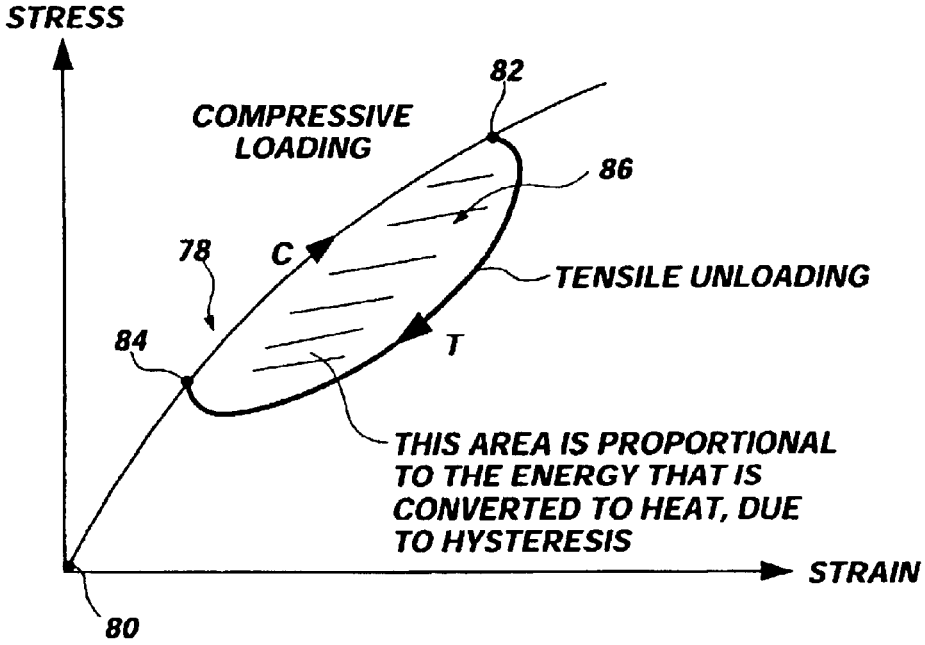
FIG. 7 is a schematic stress-strain diagram illustrating a hysteresis loop energy dissipation in a liner material shown in FIGS. 3, 4, and 5.

With reference to FIG. 7, the hysteresis effect is schematically illustrated. The stress vs. strain curve 78 here, by way of example, indicates a material which is initially loaded (deformed) in compression. The path followed in this loading 80-C-82, terminates at a point 82 where the material begins to be unloaded, or in other words is exposed to a tensile stress. Then a material which exhibits the hysteresis effect will follow an unloading path such as 82-T-84. The cross-hatched area 86 is proportional to the amount of energy that will be converted from kinetic energy to heat energy during this loading/unloading cycle in a material which exhibits the hysteresis effect. Each time the material is caused to go through such a loading/unloading cycle, another quantity of energy will be converted due to the hysteresis effect. As will be appreciated the same principles apply in a material initially loaded in tension, and unloaded in compression, though the process is the reverse mirror image of the one just described.

As will be appreciated with reference to FIG. 5, the middle "hard" layer is repeatedly subjected to this type of loading/unloading cycling because of the numerous stress wave interactions at the boundaries on both sides of this "sandwiched" layer of foam 54. The particular material selected for this layer should exhibit the hysteresis effect to a high degree to optimize the advantages of the design. The amplitude of a stress wave component which does finally propagate through the innermost layer 56 to the head 58 of the wearer is much reduced from that at the shell 16 at the point of impact.

Environmental factors can have an effect on the performance of the materials as the modulus of elasticity E changes with temperature for most foamed polymers. Accordingly Z for each material layer also changes with temperature. Also, water penetration into open cell foams, felts, and the like can affect their energy absorption properties. It has been found that closed cell foams formed of elastomeric polymer resins are advantageous in that moisture does not penetrate significantly, they are inherently buoyant, lightweight, and insulative, so that temperature is more stable overall. Further, materials having stable properties over the range of temperature (0–120 degrees Fahrenheit, for example) are desirable, as this is the usual range over which they may be expected to be exposed in outdoor use. Also, cost is a factor, and in order to make helmets attractively priced and encourage their use, the lower the cost of the liner material the more desirable it will be from this perspective.

Examples of materials for the various components which have been found to work well are as follows:

Shell: ABS (Acrylonitrile Butadiene Styrene)

Outermost layer: Ethylene Vinyl Acetate (EVA), moisture resistant, ½ inch thickness
- Firmness rating :6
- Tensile strength 50 psi
- Compression (at 25% deflection) 5 psi
- Density 2 lbs per cubic foot Middle layer: Lunacell A EVA, ¼ inch thickness
- Shore 68 A Innermost layer: Lunairflex EVA, 5/16 inch thickness, minimum
- Shore 22 A Note that the innermost layer may be supplemented by additional padding thickness in some areas for custom fitting. It can be molded to fit the wearer, or trimmed to fit, or supplemented by add-on pads to aid in fitment. In one embodiment a range of sizes are provided to provide a reasonably good fit to nearly all wearers without customization.

With reference again to FIGS. 1–3, these considerations give rise to an improved head protection system 10 in accordance with the invention, and provides advantages, particularly in whitewater sports and other activities where the environment around the helmet 12 can tend to shift it with respect to the head of the wearer, exposing a portion of the wearer's head to possible injury from impacts with rocks and other hard objects. Because the probability of head injury and being knocked unconscious is reduced in proportion to the reduction in amplitude of the stress wave component reaching the head, which gives rise to lessened accelerations at the location of the wearer's head (not shown), improved safety for the wearer is made possible. Moreover, these advantages can be obtained at a reasonable cost of manufacture due to the nature of the materials used. The advantages in performance at reasonable cost can facilitate a decrease in injury and loss of life, as use of the protective headgear will be an attractive option to the user.

It will be understood that the above-referenced arrangements are illustrative of the application for the principles of the present invention. It will be apparent to those of ordinary skill in the art that numerous modifications can be made without departing from the principles and concepts of the invention as set forth in the appended claims.

What is claimed is:

1. Protective headgear configured for protection of a portion of a wearer's head, comprising:

a shell;

a layered composite liner including a multiplicity of deformable layers, each layer having a different stiffness than adjacent layers, and wherein a layer has a higher stiffness than that of adjacent layers on either side;

a retention system configured to resist upward/rearward rotation of the headgear with respect to the wearer's head, further comprising a chin strap portion attaching the chin strap portion and fastening means slidably attaching the chin strap portion to the shell at a forward attachment location, said chin strap portion integral with a nape strap portion for extending behind and engaging the wearer's head at the nape of a neck, configured so that when a force is placed upon the shell tending to rotate it up and back so as to expose a wearer's forehead, tension is created in said strap portions, thereby pulling the shell toward the wearer's head, increasing friction between the wearer's head and the headgear and resisting upward/rearward rotation of the headgear with respect to the wearer's head.

2. Protective headgear configured for protection of a portion of a wearer's head, comprising:

a shell;

a liner;

a retention system configured to resist upward/rearward rotation of the headgear with respect to the wearer's head due to fluid flow against the wearer's head and protective headgear, further comprising a chin strap portion attaching the chin strap portion and fastening means slidably to the shell at a forward attachment location, said chin strap portion integral with a nape strap portion for extending behind and engaging the wearer's head at the nape of a neck, configured so that when a force is placed upon the shell tending to rotate it up and back so as to expose a wearer's forehead, tension is created in said strap portions, thereby pulling the shell toward the wearer's head, increasing friction between the wearer's head and the headgear and resisting upward/rearward rotation of the headgear with respect to the wearer's head.

3. Protective headgear configured for use in whitewater sporting activities, comprising:

a shell;

a liner;

a retention system configured for resisting shifting of the headgear with respect to a wearer's head, including fastening means for connecting to the shell at a forward attachment location and a rearward connection location, further comprising a strap configured to engage a rearward part of the wearer's head, slidingly attached by said fastening means to the shell at the forward attachment location and extending downward to a chin area of the wearer's head, and a strap which extends between the chin area and the shell, and is fixedly attachable to the shell by said fastening means at the rearward attachment location.

4. Protective headgear as in claim 1, made by a method comprising the steps of:

forming a shell of impact resistant resilient material;

lining the shell with a liner system having a multiplicity of layers of elastomeric material having different hardness;

configuring the layers of the liner system so that a first layer of the multiplicity of layers is less stiff than a second layer disposed outside said first layer, and a third layer disposed outside said second layer is less stiff than said second layer;

attaching a retention system to the head gear;

configuring the retention system so that an upward force on a front portion of the headgear produces an inward force tending to pull the front of the helmet inward toward the head.

5. A product by the process of claim 4, the process further comprising the steps of providing for retention of headgear on a wearer's head during a sporting activity wherein the headgear can be lifted upward and rearward with respect to the wearer's head, comprising:

providing a helmet comprising an impact resistant shell and an impact mitigation liner;

providing a forward attachment point on the helmet and a rearward attachment point on the helmet configuring a strap to engage a rear portion of the wearer's head, and to attach to the helmet at the forward attachment point and to extend down and engage a chin portion of a wearer's head.

6. The product by process of claim 5, further comprising the step of configuring a strap to attach to a rear attachment point and to extend down to at least one of a chin portion and a rear portion of the wearer's head.

7. The product by process of claim 6, further comprising the step of providing for a slidable attachment at the location of the front attachment point.

* * * * *